United States Patent [19]

Verschoore

[11] Patent Number: 4,935,194

[45] Date of Patent: Jun. 19, 1990

[54] HIGH-FLUX NEUTRON GENERATOR COMPRISING A LONG-LIFE TARGET

[75] Inventor: Gérard Verschoore, Creteil, France

[73] Assignee: U.S. Philips Corporation, New York, N.Y.

[21] Appl. No.: 339,549

[22] Filed: Apr. 17, 1989

[30] Foreign Application Priority Data

Apr. 19, 1988 [FR] France ..... 88 05147

[51] Int. Cl.[5] ..... G21G 4/02

[52] U.S. Cl. ..... 376/108; 376/109; 376/114; 376/151

[58] Field of Search ..... 376/108, 109, 110, 111, 376/114, 115, 116, 117, 151

[56] References Cited

U.S. PATENT DOCUMENTS

| | | | |
|---|---|---|---|
| 3,766,389 | 10/1973 | Fabian | 376/151 |
| 3,924,137 | 12/1975 | Alger | 376/108 |
| 3,963,934 | 6/1976 | Ormrod | 376/151 |
| 4,298,804 | 11/1981 | Colditz | 376/108 |

*Primary Examiner*—Harvey E. Behrend

*Attorney, Agent, or Firm*—Norman N. Spain

[57] ABSTRACT

A neutron generator comprising a target (16) which is struck by a hydrogen isotope ion beam and which is formed by a structure comprising a thin absorbing active layer (19) deposited on a carrier layer (18). In accordance with the invention, on the two above layers there is deposited a stack of active layers (21, 23, 25, 27) which are identical to the layer (19) and which are separated from one another by diffusion barriers (20, 22, 24, 26, respectively). The thickness of each of said active layers is in the order of the penetration depth of the deuterium ions striking the target.

5 Claims, 1 Drawing Sheet

HIGH-FLUX NEUTRON GENERATOR COMPRISING A LONG-LIFE TARGET

BACKGROUND OF THE INVENTION

The invention relates to a high-flux neutron generator, comprising a target to be struck by a hydrogen isotope ion beam, and which is formed by a structure comprising a metallic layer having a high hydrogen absorption coefficient which is deposited on a carrier layer which is made of a metal having a high thermal conductivity coefficient and a low degree of volatilization.

Generators of this kind are used for example for the examination of matter by means of fast neutrons, thermal neutrons, epithermal neutrons or cold neutrons.

The neutrons are generated by reactions between nuclei of heavy hydrogen isotopes: deuterium and tritium. These reactions take place by subjecting a target, containing deuterium and tritium, to bombardement by a beam of deuterium ions and tritium ions which are accelerated under the influence of a high potential difference. The deuterium ions and tritium ions are formed in an ion source in which a gaseous mixture of deuterium and tritium is ionized. The collision between a deuterium nucleus and a tritium nucleus produces a neutron with a binding energy of 14 MeV, and a $-\alpha$ particle with a binding energy of 3.6 MeV.

In order to obtain the maximum reaction yield, the target nucleus density should be as high as possible. A contemporary means of achieving such targets with hydrogen isotopes consists in binding of the nuclei in the crystal lattice of a hydrogenizable material.

Among these materials titanium is often used because of its lower stopping power, resulting in a higher neutron yield. These materials have the drawback, however, that they have insufficient mechanical strength when the hydrogen concentration is high and the material is provided in a "thick layer" (a splitting phenomenon causing the dispersion of the metallic particles which is detrimental to the voltage holdoff, of ion beam acceleration devices.

Consequently, these materials must be used in thin layers deposited on a carrier or substrate which must have a low absorption and diffusion coefficient for hydrogen, a suitable thermal conductivity to enable removal of the dissipated energy and a high corrosion resistance in respect of the cooling liquid. For example, a copper carrier partly satisfies these criteria but has a high sputtering coefficient. A target having suitable mechanical strength is difficult to realize by means of such a carrier, because the linear expansion coefficient of titanium deviates substantially from that of copper. Moreover, in the case of a beam with a non-uniform energy density the service life of the target is very short because of the fact, that after erosion of the titanium layer at areas of high density impact of the ion beam, the copper of the support is quickly sputtered on the surface of the surrounding titanium, thus substantially slowing the ion energy and hence the neutron yield; moreover, the carrier layer there is also pierced.

One way of avoiding this phenomenon consists in the insertion of an intermediate layer of a material such as molybdenum, having a higher ion erosion resistance and being less permeable to hydrogen and its isotopes, between the carrier layer and the metallic surface layer absorbing the hydrogen. Thus, the hydrogen ion concentration of the surface layer increases rapidly until a state of equilibrium is established in which the amount of hydrogen penetrating said surface layer is equal to that emanating therefrom by diffusion. The maximum concentration of tritium atoms is thus obtained in the thin titanium layer, so that the neutron yield is highest.

In French Patent Specification No. 7924106 (issue No. 2-438-953) the deposition of a second intermediate layer of a material, teaches that such as vanadium whose linear expansion coefficient is between that of the carrier layer and that of the first intermediate layer offers better adherence of the contacting surfaces.

The successive improvements of the target in the cited embodiments aim to prolong the service life of the target by retarding the erosion of the substrate by the ion bombardement. It is to be noted that the beam is formed by an equimolecular mixture of deuterium and tritium so that the ions extracted from the source and implanted in the target after acceleration do not lead to the depletion of the target nuclei for the benefit of the beam nuclei.

At this stage, the ion implantation of the beam takes place in layers of carrier materials whose stopping power, being much higher than that of the active layer, causes a substantial drop of the neutron emission, leading to the end of the service life of the tube.

It is the object of the invention to provide a neutron generator which comprises a target for a hydrogen isotropic ion beam, the service life of target exposed to bombardement by a high-intensity ion beam being longer than the service life of the targets of known neutron generators.

The neutron generator of the kind set forth in accordance with the invention is characterized in that the active layer having a high hydrogen absorption coefficient is formed by a stack of identical layers which are isolated from one another by a diffusion barrier, the thickness of the layers having a high absorption coefficient being equal, for example to the penetration depth of the deuterium ions striking the target. This thickness depends upon the acceleration voltage=for example about 4 microns at 250 kV.

Thus, the hydrogenation of the deep layers takes place only step-wise during the piercing of the diffusion barriers under the influence of erosion due to the bombardement. The service life of known targets, comprising only a single active layer, can thus be multiplied by the number of active layers superposed in the target in accordance with the invention.

Moreover, because the diffusion of the tritium is limited to the thickness of one layer, the concentration of the target nuclei is not reduced beyond the penetration zone of the beam; this offers the dual advantage that the impregnation of the target is accelerated and that the neutron yield is improved.

Another advantage consists in the reduction of the total quantity of the mixture of deuterium and tritium required for the operation of the generator, notably in as far as it concerns the amount of tritium which is progressively decomposed into $He_3$, thus increasing the residual pressure in the tube in a correlative fashion.

DETAILED DESCRIPTION OF THE INVENTION

The metal of the layers which are highly permeable to hydrogen belongs to the group consisting of titanium, zirconium, scandium, erbium, yttrium and the lanthanides, the metal for the carrier layer belonging to the group consisting of molybdenum, tungsten, tantalum, chromium and niobium.

The diffusion barriers can be deposited by chemical means such by nitriding in reactive plasma, (example=-titanium nitride), by oxidation, (example=titanium oxyde) or by physical means such as suitable metallic layer (example=aluminium or tungsten) deposition methods, ion implantation, (example=Nitrogen) etc. The typical thickness of the barrier is 100 to 1000 angstrom.

The invention will now be described in detail hereinafter with reference to the accompanying drawings.

Figure 1A:
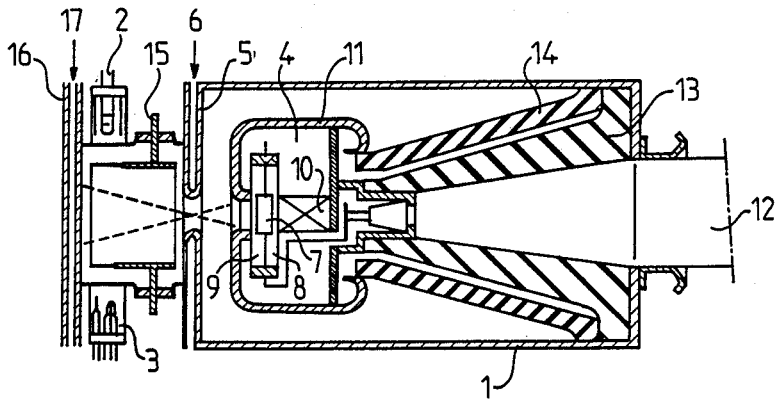
FIG. 1*a* is a diagrammatic longitudinal sectional view of a neutron generator comprising the target in accordance with the invention.

In the neutron generator shown in FIG. 1*a* an envelope 1 contains a gaseous mixture of equal parts of deuterium and tritium under a pressure in the order of some thousandths of millimeters of mercury. This gaseous mixture is supplied via a pressure regulator 2. The gaseous pressure is controlled by means of an ionization manometer 3. The mixture of deuterium and tritium is ionized in an ion source 4 and an ion beam is extracted therefrom via an accelerator electrode 5 which is integral with the envelope 1 and which is cooled at the area 6 by a water flow. With respect to the electrode 5, the anode 7 carries a very high positive potential (+VHV).

The ion source 4 is a Penning-type ion source which also comprises two cathodes 8 and 9 which carry the same negative potential in the order of 5 kV with respect to the anode 7 and a permanent magnet 10 which creates an axial magnetic field and whose magnetic circuit is closed by the ferromagnetic casing 11 which envelops the ion source 4. The positive high voltage +THT is applied to the source via the cable 12 whose end is enclosed by insulating sleeves 13 and 14.

The ion beam passes through the suppressor electrode 15 and strikes the target 16 which is cooled at the area 17 by a water flow. Part of this target is shown at a larger scale in FIG. 1*b*.

The target 16 is formed by a molybdenum substrate 18 which forms the carrier layer on which there is deposited a layer of titanium 19. In accordance with the invention, there are successively deposited a first hydrogen diffusion barrier 20, followed by a titanium layer 21, and the diffusion barriers 22, 24 and 26 in an alternating fashion with the titanium layers 23, 25 and 27, respectively of the same thickness.

The thickness of these layers is chosen in accordance with the penetration depth of the deuterium ions striking the titanium target in order to generate therein, by collision with the implanted tritium ions, a neutron emission of 14 meV. This prevents deterioration of the surface concentration of the tritium nuclei of the target which would result from their diffusion towards the interior of a thicker layer.

The regeneration of the tritium nuclei of the target is suitably ensured when the mixture inside the neutron tube of FIG. 1 consists of equal parts of deuterium and tritium.

Figure 1B:
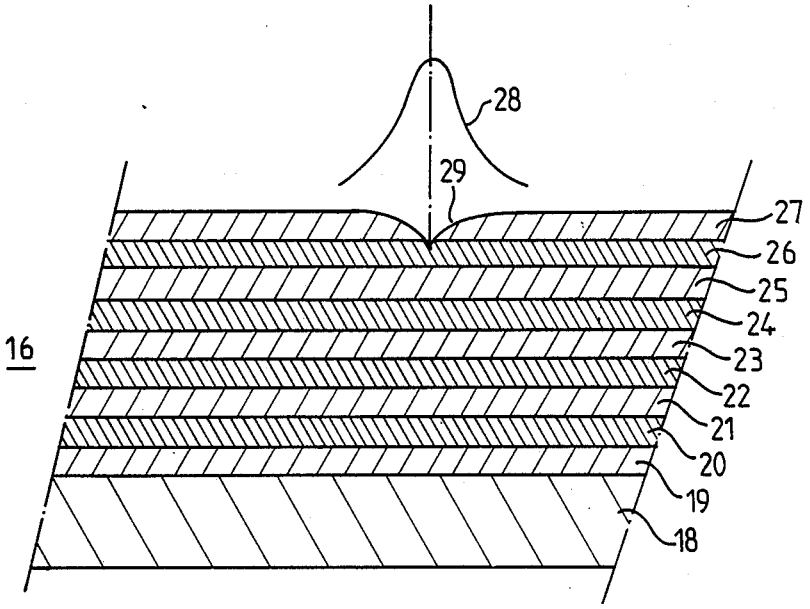
FIG. 1*b* is in an enlarged scale, a cross-sectional view of part of the target of the generator shown in FIG. 1*a*.

Because of the non-uniform density distribution of the ion beam indicated at 28 in FIG. 1*b*, a larger amount of tritium is implanted in the target zone struck by the central part of the beam so that the erosion of the first layer of titanium 27 is more pronounced as the distance from the said central part is shorter as indicated by 29. The piercing of the layer 27 thus takes place in the same central part, followed by erosion and subsequent piercing of the diffusion barrier 26. The titanium layer 25 already partly impregnated by the ions having passed the eroded zones of the layer 27 and the barrier 26 will thus be directly impregnated by the beam the barrier 24 then acting as a protector for limiting the diffusion of hydrogen ions, thus maintaining their concentration substantially at the same level as in the directly above layer.

Thus, each time when a diffusion barrier has been pierced the subjacent titanium layer is impregnated, the next barrier each time preventing the diffusion of tritium ions into the lower layers. As a result, the concentration of hydrogen ions in the successive titanium layers, and hence the neutron emission level, remain substantially constant during the erosion of the successive layers.

The construction of the target is limited to five active layers, enabling the service life to be prolonged by approximately a factor 5, multiplication of the number of layers beyond said value imposes the risk of problems which are more difficult to master.

The target in accordance with the invention can be realized by means of a cathode sputtering method comprising the following steps:

1. Deposition of a titanium layer on a molybdenum substrate constituting the anode of the sputtering device whose cathode is formed by a titanium target. This target is bombarded by the ions of a neutral and heavy gas such as argon having a high sputtering coefficient. The ionized argon atoms are subsequently applied to the substrate until the desired thickness is reached.

2. Evacuation of the argon which is replaced by nitrogen which is less heavy and which is not neutral, thus depositing a titanium nitride layer which forms the diffusion barrier on top of the underlying titanium layer.

3. Evacuation of the nitrogen which is replaced by argon in order to deposit another layer of titanium.

4. Repetition of the steps 2 and 3 as many times as desired, alternately introducing argon and nitrogen in the sputtering system without it being necessary to interrupt the deposition process.

This method of forming diffusion barriers by nitriding in reactive plasma is not limitative. It will be evident that it does not exclude the use of barriers obtained by means of any other chemical process, such as oxidation, or by a physical process such as the deposition of metallic intermediate layers or barriers produced by ion implantation.

I claim:

1. A neutron generator, comprising a target to be struck by a hydrogen isotope ion beam and which is formed by a structure comprising a metallic layer having a high hydrogen absorption coefficient which is deposited on a carrier layer which is made of a metal having a high thermal conductivity coefficient and a low degree of volatilization, characterized in that the layer having a high hydrogen absorption coefficient is formed by a stack of identical layers which are isolated from one another by a diffusion barrier, the thickness of the high absorption coefficient layers being adapted to the penetration depth of deterium ions striking the target.

2. A neutron generator as claimed in claim 1, characterized in that the metal of said layers having a high absorption coefficient belongs to the group consisting of titanium, zirconium, scandium, yttrium, erbium, and the lanthanides, and the metal for the carrier layer belongs to the group consisting of molybdenum, tungsten, tantalum, chromium and niobium.

3. A neutron generator as claimed in claim 1, characterized in that the thickness of each of said layers having a high absorption coefficient is in the order of a few microns.

4. A neutron generator as claimed in claim 1 characterized in that said diffusion barriers are chemically deposited, by nitriding in reactive plasma, or deposition of a layer passivated by oxidation, or by physical means including the deposition of suitable metallic layers or by, ion implantation.

5. The target of a neutron generator as claimed in claim 1.

* * * * *